US009340264B2

(12) United States Patent
Syvertsen et al.

(10) Patent No.: US 9,340,264 B2
(45) Date of Patent: May 17, 2016

(54) MARINE DOCKING STATIONS

(71) Applicant: Sevan Marine ASA, Arendal (NO)

(72) Inventors: Kåre Syvertsen, Tveit (NO); Dave Tallonen, Homborsund (NO); Jan Vidar Aarsnes, His (NO)

(73) Assignee: SEVAN MARINE ASA, Arendal (NO)

( * ) Notice: Subject to any disclaimer, the term of this patent is extended or adjusted under 35 U.S.C. 154(b) by 13 days.

(21) Appl. No.: 14/360,260

(22) PCT Filed: Nov. 21, 2012

(86) PCT No.: PCT/NO2012/050231
§ 371 (c)(1),
(2) Date: May 22, 2014

(87) PCT Pub. No.: WO2013/077743
PCT Pub. Date: May 30, 2013

(65) Prior Publication Data

US 2014/0290553 A1 Oct. 2, 2014

(30) Foreign Application Priority Data

Nov. 24, 2011 (NO) ..... 20111625

(51) Int. Cl.
*B63B 35/44* (2006.01)
*B63B 27/30* (2006.01)
*B63B 21/00* (2006.01)

(52) U.S. Cl.
CPC ..... *B63B 27/30* (2013.01); *B63B 21/00* (2013.01); *B63B 35/44* (2013.01)

(58) Field of Classification Search
CPC ..... B63B 27/30; B63B 21/00; B63B 35/44
USPC ..... 114/263, 264, 258, 266, 267
See application file for complete search history.

(56) References Cited

U.S. PATENT DOCUMENTS

| | | | | |
|---|---|---|---|---|
| 2,900,946 | A * | 8/1959 | Walker | 114/220 |
| 3,763,816 | A * | 10/1973 | Wilson, Jr. | 114/230.19 |
| 4,319,540 | A | 3/1982 | Koskivirta | |
| 4,786,210 | A | 11/1988 | Williams | |
| 5,112,159 | A | 5/1992 | Verret | |
| 5,911,189 | A * | 6/1999 | Ryan | 114/230.15 |
| 6,401,647 | B1 * | 6/2002 | Boston | 114/264 |

(Continued)

FOREIGN PATENT DOCUMENTS

| | | | |
|---|---|---|---|
| WO | 93/04914 | A1 | 3/1993 |
| WO | 2011/029642 | A1 | 3/2011 |

OTHER PUBLICATIONS

Search Report received for Norwegian Patent Application No. 20111625, dated Mar. 14, 2012, 2 pages.

(Continued)

*Primary Examiner* — Anthony Wiest
(74) *Attorney, Agent, or Firm* — Morrison & Foerster LLP

(57) ABSTRACT

A floating installation for temporarily accommodating objects that are being transported from a first position to a second position located on a marine installation, characterized by the floating installation including at least one marine docking station adapted for the call of a seagoing transport vessel, the at least one docking station being integrated in the installation, at least one helipad and living quarters, and a method of transporting personnel and equipment.

12 Claims, 2 Drawing Sheets

(56) References Cited

U.S. PATENT DOCUMENTS

2002/0038623 A1 4/2002 Irish
2009/0317212 A1* 12/2009 Munson, Jr. ..... 414/138.1

OTHER PUBLICATIONS

International Search Report received for PCT Patent Application No. PCT/NO2012/050231, mailed on Feb. 11, 2013, 3 pages.
Office Action received for Australian Patent Application No. 2012341140, issued on May 25, 2015, 2 pages.
International Written Opinion received for PCT Patent Application No. PCT/NO2012/050231, mailed on Feb. 11, 2013, 3 pages.
International Preliminary Report on Patentability received for PCT Patent Application No. PCT/NO2012/050231, issued on Oct. 30, 2013, 4 pages.

* cited by examiner

MARINE DOCKING STATIONS

CROSS REFERENCE TO RELATED APPLICATIONS

This application is a U.S. National Phase patent application of PCT/NO2012/050231, filed on Nov. 21, 2012, which claims priority to Norwegian Patent Application No. 20111625, filed on Nov. 24, 2011, each of which is hereby incorporated by reference in the present disclosure in its entirety.

TECHNICAL FIELD

The present invention relates to a floating installation which is suitable for objects to stay on temporarily for further transport out to an offshore installation for the production of oil and gas. In particular, the invention relates to a floating installation with an integrated docking station for safeguarding the transport of personnel and equipment.

PRIOR ART

In recent years, large deposits of oil have been found in offshore areas located far from the coastlines of the oceans. Today, to ensure the necessary transport of personnel and equipment between the mainland and the relevant offshore installation, it is common to use helicopters. However, this form of transport suffers from great drawbacks. Among other things, transport by the use of helicopters is considered to be expensive, in addition to the fact that helicopters are affected by the weather, which may, in turn, involve danger to personnel and equipment. Further, helicopters have limited ranges because of the restrictions given by weather conditions and fuel consumption. Further reasons for developing an alternative system are that a shutdown in consequence of extreme weather conditions, for example, may involve considerable costs because of an undesired stop in the oil and gas production.

Today, there are publications that describe docking systems on floating installations described above. An example is given in U.S. Pat. No. 5,112,159. However, this prior art docking system has an open solution which may cause insecurity during the transport of personnel and, consequently, a risk of injury to/loss of human life. By an open solution is meant, here, that the vessel itself and the transport between the vessel and the floating installation are in open contact with the sea and makes it highly dependent on weather conditions.

A further relevant example of an integrated docking station is disclosed in U.S. Pat. No. 4,786,210 in which a vessel is placed inside the floating installation. The primary aim of this solution is to provide a docking solution which is capable of protecting the vessel from drifting, and potentially dangerous, ice floes.

There is further an increased need for a new, efficient, safe and functional transport since the expanding market within the offshore industry entails a need for increased traffic of personnel and equipment to relevant offshore installations. An intermediate relief unit designed to receive personnel and other things solves this need by, inter alia, effectively reducing the transport time in helicopter, either to said relief units or to the final destinations thereof.

OBJECT OF THE INVENTION

The object of the present invention is to solve one or more of the above-mentioned problems in order thereby to achieve a floating installation located between the mainland and, for example, an offshore installation for the production of oil and/or gas, which, when being used, reduces the time, distance and insecurity in relation to conventional helicopter transport, while, at the same time, the need for a possible adaptation of the offshore installation itself for transport vessels to dock has been eliminated or at least substantially reduced.

SUMMARY OF THE INVENTION

The objects mentioned above are achieved with a floating installation for temporarily accommodating objects that are being transported from a first position to a second position located on a marine installation in accordance with the characterizing part of claim 1, and a method of such transport in accordance with claim 13. Preferred embodiments are described in the dependent claims 2-12.

BRIEF DESCRIPTION OF THE FIGURES

The present invention will be more easily understood with the aid of the accompanying figures, in which.

DETAILED DESCRIPTION OF THE INVENTION

Figure 1:
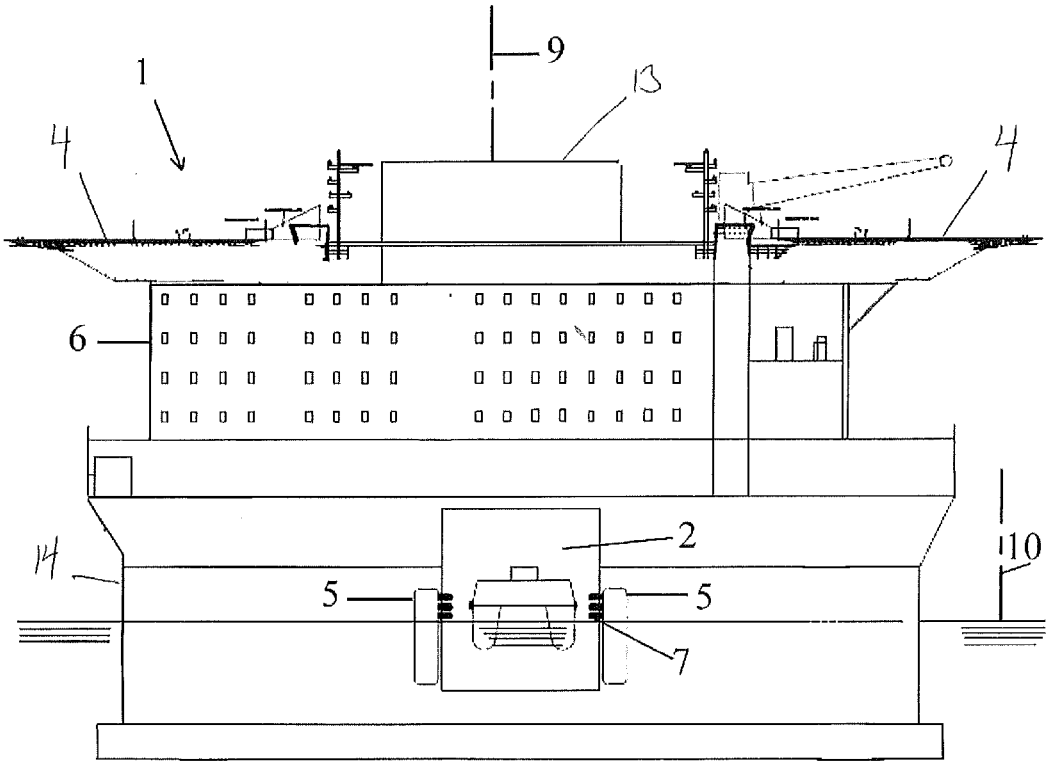
FIG. 1 shows a side view of the floating installation according to the invention.
Figure 2:
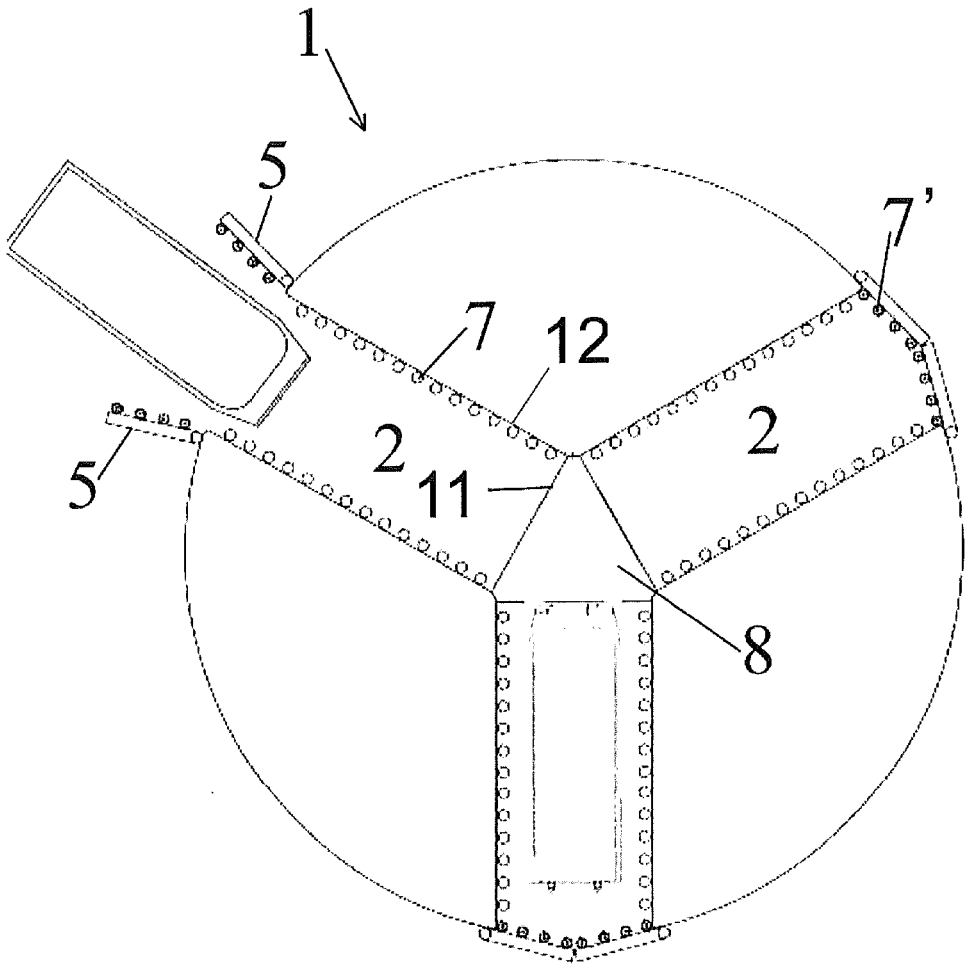
FIG. 2 shows the actual docking station according to the invention, viewed from above.

One embodiment of the present invention is illustrated in FIG. 1, in which a floating installation 1 is indicated with marine docking stations 2 which are adapted for the call of a seagoing transport vessel. This transport vessel may be a high-speed craft or any other seagoing vessel for transporting personnel and/or equipment. A typical example is a vessel with a capacity of 200 persons, but this may vary greatly, depending on the requirements placed on the relevant operation, among other things. When there is a larger distance between the inventive floating installation and the other marine installation and/or the weather conditions are bad, a vessel as large as practically possible may be advantageous.

Further, the docking stations 2 are an integrated part of the installation and are formed as channels large enough to accommodate said transport vessel. The channels 2 may be arranged side by side, radially or in some other practical manner. However, in one preferred embodiment, the channels 2 are arranged in such a way that the transport vessels may always be docked on a leeward side of the installation 1.

The installation 1 is provided with at least one helipad 4, for example four or five, from which personnel and equipment, arriving either from said offshore installation suitable for, for example, oil and gas production or from the mainland, are transported further. FIG. 1 also shows an associated helicopter hangar 13 for storing and maintaining/repairing helicopters and other things.

The installation is also provided with appropriate living quarters 6 functioning as a living area and/or overnight stop for a larger number of persons. A typical example is living quarters 6 sleeping 400-600 but, in many cases, living quarters sleeping a considerably larger number may be appropriate.

The marine docking station 2 is preferably provided with at least one gate/door 5 which is formed in such a way that it/they prevent(s), or at least reduce(s), the formation of wave movements into the docking station 2 in its/their closed state. Possibly, other devices might be added that could function as breakwaters at or in the vicinity of the entrance of the docking station. While the gate(s) 5 facilitate(s) transport onto the installation from the vessel, the latter breakwater device will reduce the risk/difficulties when a relevant vessel is to be guided into the relevant docking station 2. Preferably, at least one of the at least one gate/door 5 is completely or partially watertight in its closed state.

In order to ensure the ability of the vessel always to dock on the leeward side of the installation 1, it is advantageous for the installation 1 to be formed with at least three docking stations 2*a-c*, wherein at least three of the at least three docking stations 2*a-c* are spaced apart in a symmetric or near-symmetric configuration around the centre axis 9 of the installation 1, for example separated by an angle of 120 degrees.

Further, at least one of the docking stations 2 may be provided with at least one boarding platform 8 located on or near the inner wall 11 of the docking station 2 in question, that is to say the wall nearest to the centre axis 9 of the installation, in order to facilitate movement from the vessel to the installation 1 of both personnel and equipment.

The docking system 2 of the floating installation 1 may further be formed with at least one guiding arrangement 7, 7' of such a configuration as to facilitate the calling of the incoming/outgoing transport vessel. As a consequence, this gives further safety when the vessel is being guided into/entering the relevant docking station 2.

In a possible embodiment, at least one of the at least one gate/door 5 installed on its associated docking station 2 is formed with one or more of said guiding arrangements 7, 7'. In addition, or alternatively, to being installed on the at least one gate 5, one or more of the at least one guiding arrangement 7, 7' may be installed on the inner walls (for example side walls 12) of the docking station 2 in question. For example, one or more of the at least one guiding arrangement 7, 7' may include one or more wheels rotatable around a particular axis of rotation. This axis of rotation may most appropriately lie along a constantly vertical axis 10 relative to the earth or along an axis that follows any movements of the axial centre axis 9 of the installation 1. A typical guiding arrangement 7, 7' includes one or more fenders. A typical embodiment may be a fixed guiding arrangement 7 installed on the inner side walls 12 of the docking station 2 in question, combined with a solution using a guiding arrangement 7' with rotating elements installed on the gate door(s) 5.

With advantage, the inventive installation 1 may include a circular or near-circular main hull 14 and include at least one deck for personnel and equipment. These decks may be used as required, for example for storing necessary consumer goods and for personnel to stay on. Said main hull 14 may, with advantage, contain one or more storage volumes, for example for the storage of fuel and/or bulk material. Typically, such a storing volume may correspond to about half the hull volume.

The invention also includes a method of transporting personnel and equipment between the mainland and a floating installation 1 in accordance with one or more of the features given above. This method comprises the following steps:

positioning the transport vessel at the leeward side of the floating installation, opening the at least one gate/door 5 of the docking station 2, guiding the transport vessel into one of the at least one docking station 2 by the use of a guiding arrangement 7, 7', placing one end of the transport vessel against a boarding platform 8 and transferring personnel and equipment between the transport vessel and the floating installation 1.

The invention claimed is:

1. A floating installation comprising:

a circular or near-circular main hull;

a plurality of marine docking stations, each adapted for receiving a seagoing transport vessel and being integrated in the installation; and a boarding platform to facilitate movement from the vessel to the installation, wherein the docking stations are spaced apart symmetrically or near-symmetrically around the center axis of the installation;

the boarding platform is located at the center axis of the installation so as to connect with all the docking stations, each of the docking stations is formed as a channel having sidewalls, and a sidewall of a first docking station is substantially connected, at a periphery of the boarding platform, to a sidewall of a second docking station adjacent the first docking station.

2. The floating installation according to claim 1, wherein the at least one marine docking station is provided with at least one gate/door of such a configuration so as to prevent or reduce formation of wave movements inside the docking station(s) in its closed state.

3. The floating installation according to claim 2, wherein the at least one gate/door is a pivoting gate/door.

4. The floating installation according to claim 2, wherein at least one of the at least one gate/door is completely or partially watertight in its closed state.

5. The floating installation according to claim 2, wherein one or more of at least one guiding arrangement includes wheels with an axis of rotation lying parallel to the center axis of the installation.

6. The floating installation according to claim 1, wherein the at least one docking station is arranged in such a way that a respective transport vessels may always be docked on a leeward side of the installation.

7. The floating installation according to claim 1, wherein the installation includes at least three docking stations, the docking stations being spaced apart symmetrically or near-symmetrically around the center axis of the installation.

8. The floating installation according to claim 1, wherein at least one of the marine docking stations is formed with at least one guiding arrangement for the transport vessel, and the at least one guiding arrangement is installed entirely or partially on one or more of at least one gate/door associated with the at least one docking station.

9. The floating installation according to claim 1, wherein one or more of at least one guiding arrangement includes at least one fender.

10. The floating installation according to claim 1, wherein the installation includes at least one deck for personnel and equipment.

11. The floating installation according to claim 1, wherein the boarding platform is arranged between the inner walls of each docking station.

12. A method of transporting personnel and equipment between a first position and a floating installation by means of a transport vessel, the method comprising the steps of:

positioning the transport vessel at a leeward side of the floating installation of claim 1, opening at least one gate/door of a docking station, guiding the transport vessel into the docking station using a guiding arrangement through the opened at least one gate/door, placing one end of the transport vessel against a boarding platform that is located at the center axis of the installation, and transferring personnel and equipment between the transport vessel and the floating installation using the boarding platform.

* * * * *